US007137397B2

(12) United States Patent
Rosenbauer et al.

(10) Patent No.: US 7,137,397 B2
(45) Date of Patent: Nov. 21, 2006

(54) DISHWASHER RACK ASSEMBLY

(75) Inventors: Michael Rosenbauer, Reimlingen (DE); Bernd Schessl, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/174,087

(22) Filed: Jun. 17, 2002

(65) Prior Publication Data

US 2002/0185166 A1 Dec. 12, 2002

Related U.S. Application Data

(63) Continuation of application No. PCT/EP00/11039, filed on Nov. 8, 2000.

(30) Foreign Application Priority Data

Dec. 16, 1999 (DE) ..... 199 60 842

(51) Int. Cl.
*B08B 3/04* (2006.01)

(52) U.S. Cl. ..... 134/56 D; 134/58 D; 134/200; 312/228.1; 211/41.8

(58) Field of Classification Search ..... 312/228, 312/228.1, 311; 211/41.2, 41.8, 41.9, 181.1; D32/55; 134/56 D, 57 D, 58 D, 200, 201; 220/488

See application file for complete search history.

(56) References Cited

U.S. PATENT DOCUMENTS

| | | | | |
|---|---|---|---|---|
| 3,146,045 | A * | 8/1964 | Kauffman | 312/311 X |
| 3,960,290 | A * | 6/1976 | Yake et al. | 220/835 |
| 4,498,594 | A * | 2/1985 | Elder | 211/41.9 |
| 4,830,200 | A * | 5/1989 | Zambano et al. | 211/133.5 |
| 4,927,033 | A * | 5/1990 | Patera et al. | 211/41.9 |
| 5,102,225 | A * | 4/1992 | Hollinger et al. | 383/23 |
| 5,480,035 | A * | 1/1996 | Smith | 211/41.8 |
| 5,601,195 | A * | 2/1997 | Finola et al. | 312/311 X |

FOREIGN PATENT DOCUMENTS

| | | | |
|---|---|---|---|
| DE | 35 20 148 A1 | | 12/1986 |
| DE | 297 09 901 U1 | | 9/1997 |
| EP | 0 143 754 A1 | | 6/1985 |
| EP | 0 385 877 A1 | | 9/1990 |
| EP | 937436 | * | 8/1999 |
| GB | 2 033 735 A | | 5/1980 |

* cited by examiner

*Primary Examiner*—James O. Hansen
(74) *Attorney, Agent, or Firm*—Russell W. Wamock; Craig J. Loest

(57) ABSTRACT

A dish rack includes a base rack of a wire framework and at least one rack side element that is releasably connected to the base rack and, as seen by a user who is loading the dish rack with items which are to be washed, is fitted laterally thereto. A cutlery-accommodating device is integrated in the rack side element to produce an integral dish rack the allows, on one hand, the straightforward construction of the base rack—preferably in the form of a U—and, on the other hand, the releasable fastening of the rack side element to an integrated cutlery-accommodating device.

23 Claims, 1 Drawing Sheet

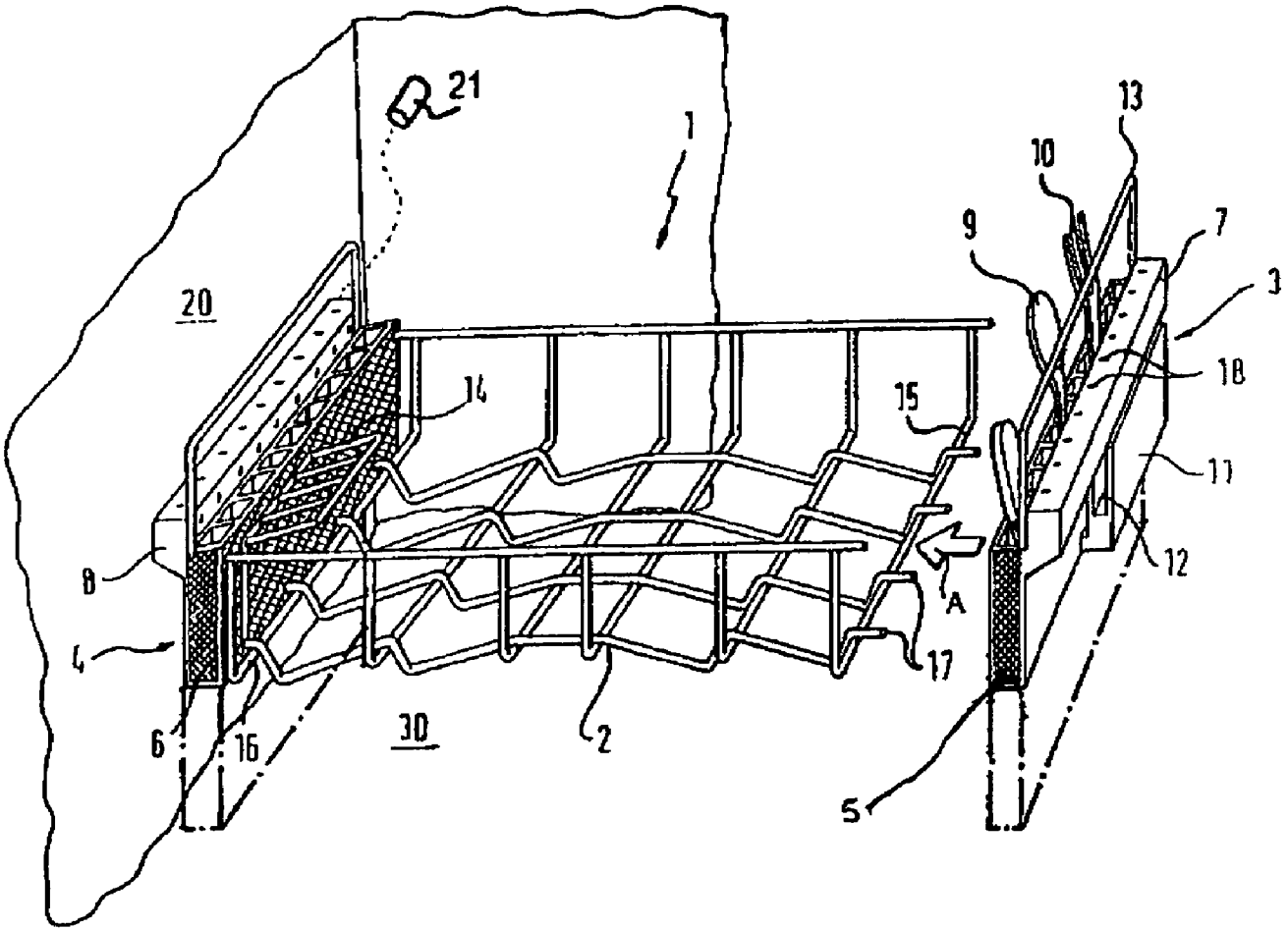
3
7
18
11
12
13
10
9
15
A
17
5
1
2
21
14
30
20
16
6
8
4

DISHWASHER RACK ASSEMBLY

CROSS-REFERENCE TO RELATED APPLICATION

This application is a continuation of copending International Application No. PCT/EP00/11039, filed Nov. 8, 2000, which designated the United States and was not published in English.

BACKGROUND OF THE INVENTION

1. Field of the Invention

The invention relates to a dishwasher with at least one pullout dish rack that is intended for accommodating items that are to be washed and has a base rack including a wire framework.

The prior art includes placing one or two pull-out dish racks for accommodating items that are to be washed—e.g., pieces of crockery such as plates, cups, glasses, cutlery, etc.—in a dishwashing compartment of a dishwasher.

European Patent Application EP 0 143 754 A1 discloses a dishwasher with two dish racks that are intended for accommodating items that are to be washed and each have a U-shaped base rack. Different additional elements may be coupled to the end side of the base rack through snap-connection closures to make possible for the dish rack, including the base rack and variable end element, to be adapted, regardless of its installation location, to the size and the construction of the dishwashing compartment.

SUMMARY OF THE INVENTION

It is accordingly an object of the invention to provide a dishwasher with a dish rack that overcomes the hereinaforementioned disadvantages of the heretofore-known devices of this general type and that is of straightforward construction and flexibly accommodates items that are to be washed.

With the foregoing and other objects in view, there is provided, in accordance with the invention, a dishwasher assembly, including at least one pull-out dish rack for accommodating items to be washed, the dish rack having a wire frame base rack having lateral sides and at least one rack side element releasably connected to at least one of the lateral sides, and the side element having an integrated cutlery-accommodating device. Preferably, the dishwasher assembly is part of a dishwasher and is disposed in the dishwashing compartment, and the dish rack is moveably disposed in the compartment.

Taking as the departure point a dish rack with the base rack including a wire framework, at least one rack side element, in accordance with the subject matter of the invention, is connected releasably to the base rack and, as seen by a user who is loading the dish rack with items that are to be washed, is fitted laterally. A cutlery-accommodating device is integrated in the rack side element. Such a configuration gives an integral dish rack that allows, on one hand, the straightforward construction of the base rack—preferably in a U-shape—and, on the other hand, the releasable fastening of the rack side element to an integrated cutlery-accommodating device. The advantages in comparison with the conventional dish rack are lower production outlay, improved differentiation possibilities in relation to prior art appliances and, in particular, the capability of integrating an additional element in the dish rack in the form of the special cutlery-accommodating device.

If the invention is used in the top rack, there results a particularly ergonomic configuration for the user of the dishwasher. Such a configuration makes it possible for the user to load the dishwasher with cutlery without bending down to a cutlery box, which is usually disposed in the bottom rack. This configuration advantageously results in a free and open configuration of the bottom rack without obstruction by the cutlery box. A long useful length of the lateral rack side element with integrated cutlery-accommodating device makes it possible for pieces of cutlery to be accommodated individually, which, furthermore, contributes to an improvement in the washing results.

In accordance with another feature of the invention, it has proven advantageous for one rack side element with an integrated cutlery-accommodating device to be disposed respectively on both sides of the base rack. It is even possible to enhance the above advantages by way of the releasable fastening of rack side elements with integrated cutlery-accommodating devices on both sides of the base rack.

In accordance with a further feature of the invention, a spray bar is integrated in the rack side element for subjecting the pieces of cutlery accommodated by the cutlery-accommodating device to the action of a cleaning liquid. It is, thus, possible to further improve the cleaning result for the cutlery and, moreover, to individualize the washing for certain pieces of cutlery.

In accordance with an added feature of the invention, the spray bar is coupled hydraulically to a feed line for the cleaning liquid because, in this way, the water is simply supplied through the rear feed line, disposed in the dishwashing compartment, for the top spray arm. It is, thus, possible for the pieces of cutlery to be disposed in the integrated cutlery-accommodating device with their handles oriented upward, causing the pieces of cutlery to be washed in a specifically targeted manner. Such washing advantageously results in better hygiene and safety for the user.

In accordance with an additional feature of the invention, an adjusting device for adjusting the dish rack is preferably integrated in the rack side element, which, in particular, when used in the top rack in the compartment, is accompanied by a relatively large amount of freedom of construction and cost reductions, along with increased flexibility.

In accordance with yet another feature of the invention, there is provided additional functional means or elements, for example, a handle, a deflecting bracket, and/or a ledge, fitted or mounted on the rack side element. Preferably, the base rack has an interior and the ledge projects into the interior.

In accordance with yet a further feature of the invention, the rack side element with the cutlery-accommodating device of a dish rack used as a top rack is extended downward. Such a configuration makes it possible, in particular, for long pieces of cutlery to be accommodated particularly well without encroaching in the region of a spray device—e.g., in the form of a spray arm.

In respect of the low production outlay, it is particularly advantageous, in accordance with a concomitant feature of the invention, for the rack side element to be of a plastic part.

Other features that are considered as characteristic for the invention are set forth in the appended claims.

Although the invention is illustrated and described herein as embodied in a dishwasher, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is a perspective view of an integral dish rack according to the invention.

DESCRIPTION OF THE PREFERRED EMBODIMENTS

Referring now to the single FIGURE of the drawing, it is seen that dishwasher 20 has a dishwashing compartment 30 for accommodating items that are to be washed—preferably pieces of crockery such as cups, saucers, plates, and/or pieces of cutlery. The compartment 30 is closed by a non-illustrated door. The items that are to be washed are usually disposed in two pull-out dish racks and a separate cutlery box. Of these racks, one dish rack 1 is illustrated in the present example. The invention can be used both in a top rack and in a bottom rack. The dish rack 1 includes a U-shaped base rack 2 and two rack side elements 3 and 4 that are fastened releasably on the right-hand and left-hand sides of the base rack 2—as seen by a user who is loading the dish rack 1 with items that are to be washed. The rack side element 3, which is disposed on the right-hand side of the base rack 2, is shown in the released state, while the rack side element 4 disposed on the left-hand side of the base rack 2 has been connected, as an example, to the base rack 2.

The base rack 2 has a wire framework with bent longitudinal and transverse struts on the rack base. The releasable fastening of the lateral rack side elements 3, 4 on the base rack 2 takes place, for example, on the end struts 15 and 16, which terminate the rack base on both sides. These end struts 15, 16 are extended by latching pins 17—preferably likewise made of wire—which latch into corresponding latching holes of the rack side elements in the connected state and unlatch again to release the connection. In the example illustrated, the right-hand end strut 15 of the rack base has a total of four latching pins 17 that, when the rack side element 3 is moved in the direction of the rack base (see arrow A), penetrate into the same number of non-illustrated latching holes. A cutlery-accommodating device 5, 6 is integrated in each rack side element 3, 4. The cutlery-accommodating device 5, 6 device preferably is constructed as a narrow cutlery strip with mounts for pieces of cutlery—see, for example, pieces of cutlery 9, 10 in the right-hand rack side element 3. Such a configuration produces an integral dish rack that, in comparison with a conventional dish rack, has advantages in respect of production outlay and, in particular, provides a capability of integrating individual cutlery-accommodating devices for loading with pieces of cutlery. If the invention is used in the top rack, the configuration gives a particularly ergonomic configuration for the user of the dishwasher because the configuration makes it possible for the user to place the pieces of cutlery without bending down to the cutlery box, which is usually disposed in the bottom rack. The long useful length, extended over the entire width of the rack base, of the lateral rack side element 3, 4 with integrated cutlery-accommodating device 5, 6 contributes particularly to an improvement in the washing result.

On both sides of the base rack 2, the respective rack side element 3, 4 preferably also has an integrated spray bar 7, 8 for subjecting the pieces of cutlery accommodated by the respective cutlery-accommodating device 5, 6 (see parts 9, 10 in the rack side element 3) to the action of a cleaning liquid. It is, thus, possible to further improve the cleaning result for the cutlery and, moreover, to individualize the washing for certain pieces of cutlery. The spray bar 7, 8 is preferably coupled hydraulically to a feed line 21 for the cleaning liquid and has spray holes 18 in the surface for the water to be particularly simply supplied through the rear feed line 21, disposed in the dishwashing compartment. Such a feed line 21 is provided for the top spray arm. It is, thus, also possible for pieces of cutlery to be disposed in the integrated cutlery-accommodating device 5, 6 with their handles oriented upward, which causes the cutler pieces to be washed in a specifically targeted manner. Such washing advantageously results in better hygiene and safety for the user.

A convenient adjusting device 11 for adjusting the dish rack is also integrated in the rack side element 3, which, in particular, when used in the top rack, results in a relatively large amount of freedom of the configuration for loading with pieces of crockery and pieces of cutlery and a reduction in cost. There is also increased flexibility. Further additional elements are preferably provided on the rack side element 3, e.g., a handle 12, which is coupled to the adjusting device 11, and an upwardly oriented deflecting bracket 13. These additional elements or functional devices may also be fitted on the left-hand lateral rack side element 4. A ledge 14, on which it is possible to place items that are to be washed, is, moreover, mounted on the left-hand lateral rack side element 4. The rack side elements 3, 4 with integrated cutlery-accommodating device 5, 6 of a dish rack 1 used as a top rack can be extended downward to make possible, in particular, for long pieces of cutlery to be accommodated particularly well without encroaching in the region of a spray device—e.g., in the form of a spray arm. Extension of the rack is illustrated by dashed-dot lines in the FIGURE of the drawing.

In respect of the low production outlay, it is particularly advantageous if the rack side elements 3, 4 are produced from plastic.

We claim:

1. A dishwasher assembly, comprising:

at least one pull-out dish rack configured to move along an axis and for accommodating items to be washed, said dish rack having:

a wire frame base rack having a horizontally extending portion having two lateral sides, a front side substantially perpendicular to the axis rising upwardly from said horizontally extending portion, a back side substantially perpendicular to the axis rising upwardly from said horizontally extending portion, and said two lateral sides of said horizontally extending portion each extending substantially parallel to the axis, wherein said dish rack generally has the shape of the letter "U" in that said front and back sides of said wire frame base rack rise upwardly from said horizontally extending portion and form the legs of the letter "U" with the uppermost portions of each of said front and back sides of said wire frame base rack forming the respective tops of the legs of the letter "U" and said horizontally extending portion forming the lower part of the letter "U" that interconnects its legs; and at least one rack side element releasably connected to at least one of said lateral sides; and said rack side element having an integrated cutlery-accommodating device disposed laterally outside said at least one of said lateral sides and said rack side element having an integral spray bar for subjecting pieces of cutlery accommodated by said cutlery-accommodating device to action of a cleaning liquid, said rack side element being in engagement with said horizontal extending portion of said wire frame base rack, extending from said front side of said wire frame base rack to said back side of said wire frame base rack and having a height extent therebetween that extends from the engagement of said side element with said horizontal extending portion of said wire frame base rack to at least the uppermost portions of each of said front and back sides of said wire frame base rack forming the respective tops of the legs of the letter "U".

2. The dishwasher assembly according to claim 1, wherein:

said at least one rack side element is two rack side elements; and each of said two rack side elements:

have an integrated cutlery-accommodating device; and are respectively disposed on one of said two lateral sides.

3. The dishwasher assembly according to claim 1, wherein said spray bar is to be hydraulically coupled to a feed line for dispensing cleaning liquid.

4. The dishwasher assembly according to claim 1, wherein said rack side element has an integral adjusting device for adjusting placement of said dish rack.

5. The dishwasher assembly according to claim 1, wherein said rack side element has a handle.

6. The dishwasher assembly according to claim 1, wherein said rack side element has a deflecting bracket.

7. The dishwasher assembly according to claim 1, wherein said rack side element has a ledge.

8. The dishwasher assembly according to claim 7, wherein:

said wire frame base rack has an interior; and said ledge projects into said interior.

9. The dishwasher assembly according to claim 1, wherein said rack side element is to be used as a top rack and is extended in a downward direction.

10. The dishwasher assembly according to claim 1, wherein said rack side element is a plastic part.

11. The dishwasher assembly according to claim 1, wherein said lateral sides are sides of said wire frame base rack as seen by a user when loading said dish rack with items to be washed.

12. The dishwasher assembly according to claim 1, wherein said cutlery-accommodating device has at least one pocket formed therein for accommodating cutlery.

13. A dishwasher, comprising:

a dishwashing compartment; and at least one pull-out dish rack configured to move along an axis and for accommodating items to be washed, said dish rack having:

a wire frame base rack having a horizontally extending portion having two lateral sides, a front side substantially perpendicular to the axis rising upwardly from said horizontally extending portion, a back side substantially perpendicular to the axis rising upwardly from said horizontally extending portion, and said two lateral sides of said horizontally extending portion each extending substantially parallel to the axis, wherein said dish rack generally has the shape of the letter "U" in that said front and back sides of said wire frame base rack rise upwardly from said horizontally extending portion and form the legs of the letter "U" with the uppermost portions of each of said front and back sides of said wire frame base rack forming the respective tops of the legs of the letter "U" and said horizontally extending portion forming the lower part of the letter "U" that interconnects its legs; and at least one rack side element releasably connected to at least one of said lateral sides; and said rack side element having an integrated cutlery-accommodating device disposed laterally outside said at least one of said lateral sides and said rack side element having an integral spray bar for subjecting pieces of cutlery accommodated by said cutlery-accommodating device to action of a cleaning liquid, said rack side element being in engagement with said horizontal extending portion of said wire frame base rack, extending from said front side of said wire frame base rack to said back side of said wire frame base rack and having a height extent therebetween that extends from the engagement of said rack side element with said horizontal extending portion of said wire frame base rack to at least the uppermost portions of each of said front and back sides of said wire frame base rack forming the respective tops of the legs of the letter "U".

14. The dishwasher according to claim 13, wherein:

said at least one rack side element is two rack side elements; and each of said two rack side elements:

have an integrated cutlery-accommodating device; and are respectively disposed on one of said two lateral sides.

15. The dishwasher according to claim 13, wherein:

said compartment has a feed line for supplying cleaning liquid; and said spray bar is hydraulically coupled to said feed line for dispensing the cleaning liquid through said spray bar.

16. The dishwasher according to claim 13, wherein said rack side element has an integral adjusting device for adjusting placement of said dish rack in said compartment.

17. The dishwasher according to claim 13, wherein said rack side element has a handle.

18. The dishwasher according to claim 13, wherein said rack side element has a deflecting bracket.

19. The dishwasher according to claim 13, wherein said rack side element has a ledge.

20. The dishwasher according to claim 19, wherein:

said wire frame base rack has an interior; and said ledge projects into said interior.

21. The dishwasher according to claim 13, wherein said rack side element is a top rack of said compartment and is extended in a downward direction.

22. The dishwasher according to claim 13, wherein said rack side element is a plastic part.

23. The dishwasher according to claim 13, wherein said lateral sides are sides of said wire frame base rack as seen by a user when loading said dish rack with items to be washed.

* * * * *